US005136730A

United States Patent [19]

Casale

[11] Patent Number: 5,136,730

[45] Date of Patent: Aug. 11, 1992

[54] LAVATORY PAN SEAT

[76] Inventor: Enzo Casale, Lodge Farm House, Elmers Lane, Saxlingham Thorpe, Norwich, Norfolk, England

[21] Appl. No.: 740,729

[22] Filed: Aug. 6, 1991

[30] Foreign Application Priority Data

Aug. 22, 1990 [GB] United Kingdom ..... 9018390

[51] Int. Cl.[5] ..... E03D 9/052

[52] U.S. Cl. ..... 4/213; 4/217

[58] Field of Search ..... 4/213, 217, 216

[56] References Cited

U.S. PATENT DOCUMENTS

| | | | |
|---|---|---|---|
| 988,273 | 3/1911 | Levenhagen et al. | 4/217 |
| 2,286,555 | 6/1942 | Long | 4/213 |
| 2,696,619 | 12/1954 | Ring | 4/217 |
| 2,824,313 | 2/1958 | Bulow | 4/213 |
| 3,740,772 | 6/1973 | Paley | 4/217 |
| 4,071,915 | 2/1978 | Kurataro | 4/217 |
| 4,125,906 | 11/1978 | Weiland | 4/217 |
| 4,175,293 | 11/1979 | Stephens et al. | 4/213 X |
| 4,251,888 | 2/1981 | Turner | 4/213 |
| 4,344,194 | 8/1982 | Pearson | 4/213 |
| 4,586,201 | 5/1986 | Todd, Jr. | 4/217 |

FOREIGN PATENT DOCUMENTS

| | | | |
|---|---|---|---|
| 0610613 | 4/1979 | Switzerland | 4/217 |

*Primary Examiner*—Henry J. Recla
*Assistant Examiner*—Robert M. Fetsuga
*Attorney, Agent, or Firm*—Edwin D. Schindler

[57] ABSTRACT

A lavatory pan seat generally of conventional shape and adapted to be mounted to the pan at the back of the rim by a hinge, the seat having air inlet apertures at its inner periphery communicating with an air channel within the seat which also communicates with an air extraction passage connected to a hose leading to an extractor fan, the hinge comprising a hollow center piece fixed to the pan and two hollow cheeks pivotally mounted to the center piece, whereby the air extraction passage extends from the internal air channel to the fan hose through said cheeks and center piece.

6 Claims, 10 Drawing Sheets

LAVATORY PAN SEAT

FIELD OF THE INVENTION

This invention relates to a lavatory pan seat.

BACKGROUND TO THE INVENTION

The rooms in which lavatories are housed can be rendered unpleasantly odorous after use of the lavatory, and partly for this reason these rooms are sometimes equipped with extractor fans to communicate the room atmosphere with the atmosphere outside the building. It has also been proposed to provide the lavatory with an air extraction means. In these known proposals, the lavatory seat has been provided with an internal air channel leading from air inlets at the inner periphery of the seat to an air extraction outlet at the outer periphery of the seat, the air extraction outlet communicating with an air outlet tube or pipe through which air is drawn by a fixedly mounted fan into a stench pipe or the atmosphere outside the building. Because the seat is hinged to the lavatory pan, various difficulties arise, including that of providing communication between the internal air channel of the hinged seat and the fixed fan (or associated fixed passageway in which the fan is mounted). Commonly, a flexible hose is employed to connect between the air extraction outlet of the hinged seat and the fixed fan structure. This flexible hose tends to be conspicuous, and it can affect the free hinging of the seat.

BRIEF SUMMARY OF THE INVENTION

According to the invention, there is provided a lavatory pan seat having a shape generally conforming to the shape of the rim of a conventional lavatory pan and adapted to be hinged to said pan at the back of the rim by a hinging means, wherein the seat has at least one air inlet aperture in its wall adjacent its inside periphery, communicating with a passage for air extraction in the hinging means, said hinging means comprising a hollow centre piece adapted to be fixed to the pan and two cheeks on the seat, one on each side of the central piece and pivotally mounted to turn relatively to said centre piece, at least one of said cheeks being hollow and the air extraction passage passing through at least said one hollow cheek into the centre piece.

In accordance with the invention, therefore, the hinging means employed for the seat is formed hollow to enable air extraction via said hinging means. As the centre piece of the hinging means is fixed, no problem arises in connecting the fixed fan structure to it, and a relatively non-flexible and less conspicuous connecting hose or the like can be employed.

BRIEF DESCRIPTION OF DRAWINGS

Further features and advantages of the lavatory seat in accordance with the invention will be apparent from the following description of an embodiment, making reference to the accompanying drawings, in which.

DESCRIPTION OF EMBODIMENTS

Figure 1:
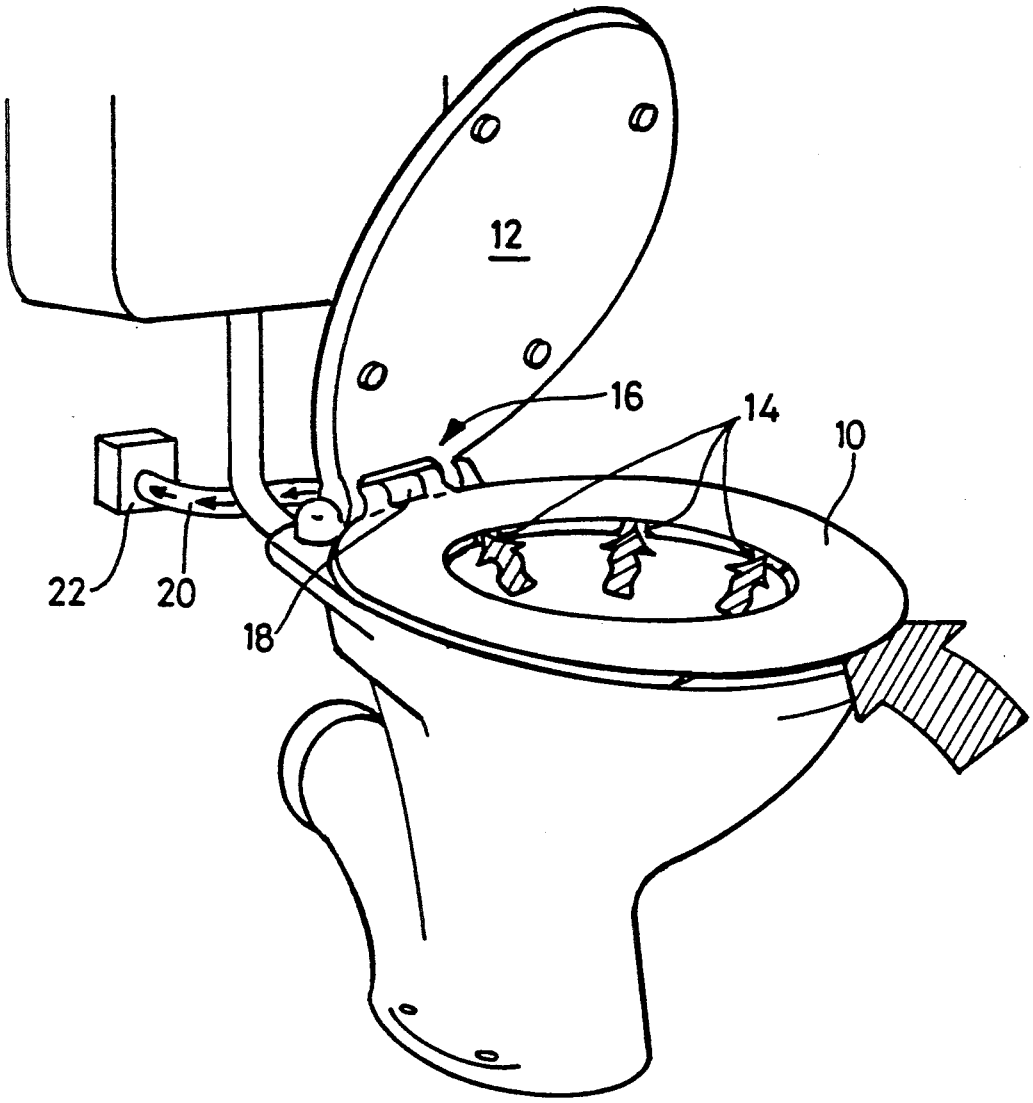
FIG. 1 is a pictorial view of a lavatory pan equipped with a pan seat in accordance with the invention.
Figure 2:
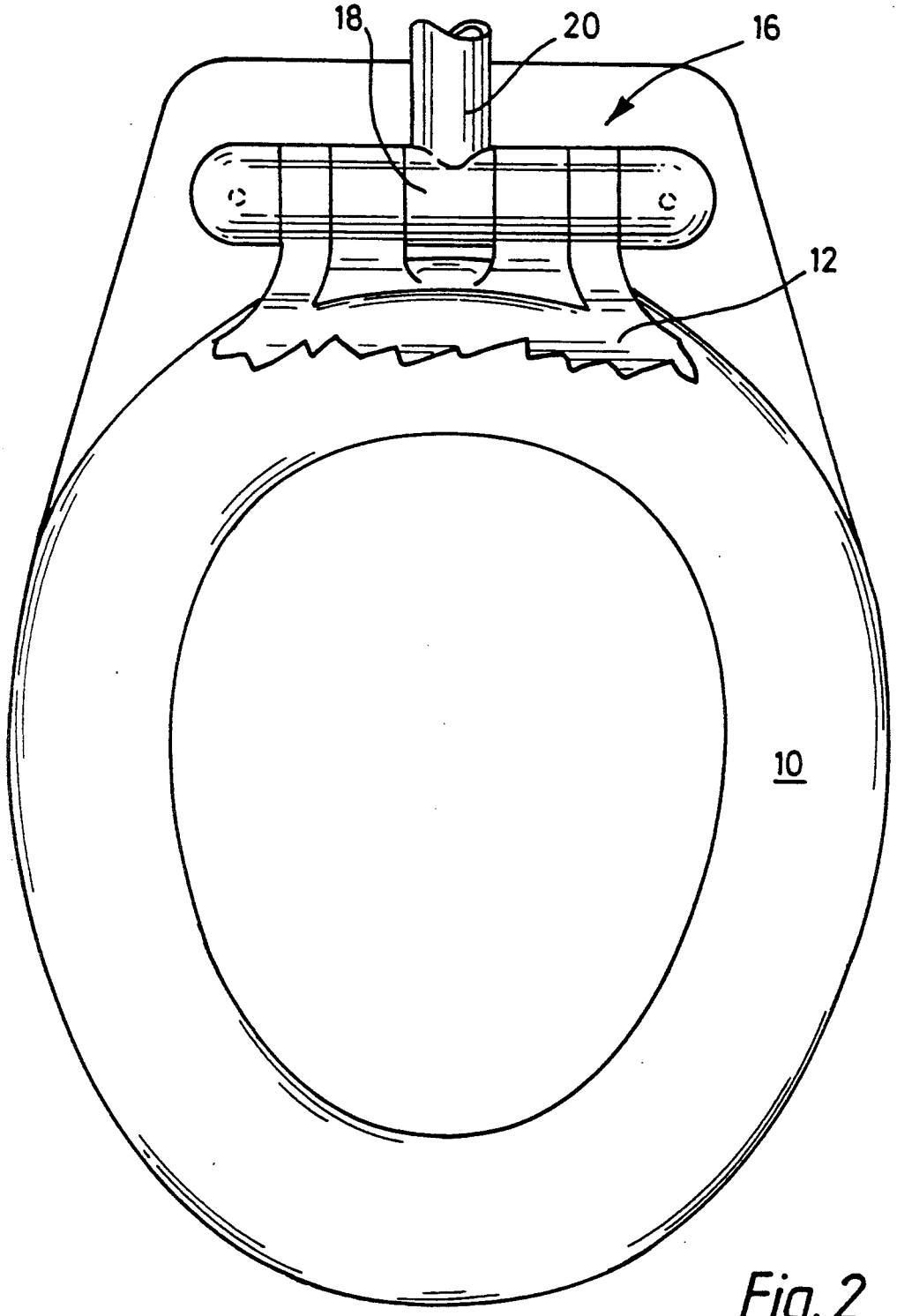
FIG. 2 is a plan view of the seat, the seat cover being cut away.

Referring to FIGS. 1 and 2, the illustrated lavatory is provided with a pan seat 10 in accordance with the invention. Reference 12 denotes a seat cover. The seat has a series of air inlet openings 14 around its inside periphery, which via a not visible internal air channel communicate with a hollow hinging means 16. A fixed centre piece 18 of the hollow hinging means connects with an air outlet pipe 20 leading to a housing 22 containing an extractor fan (not shown), whereby air from inside the pan is drawn out to a stench pipe or to the atmosphere outside the building containing the room in which the lavatory is housed. In FIG. 1, the arrows indicate the air flow which takes place when the fan is operative.

Figure 3:
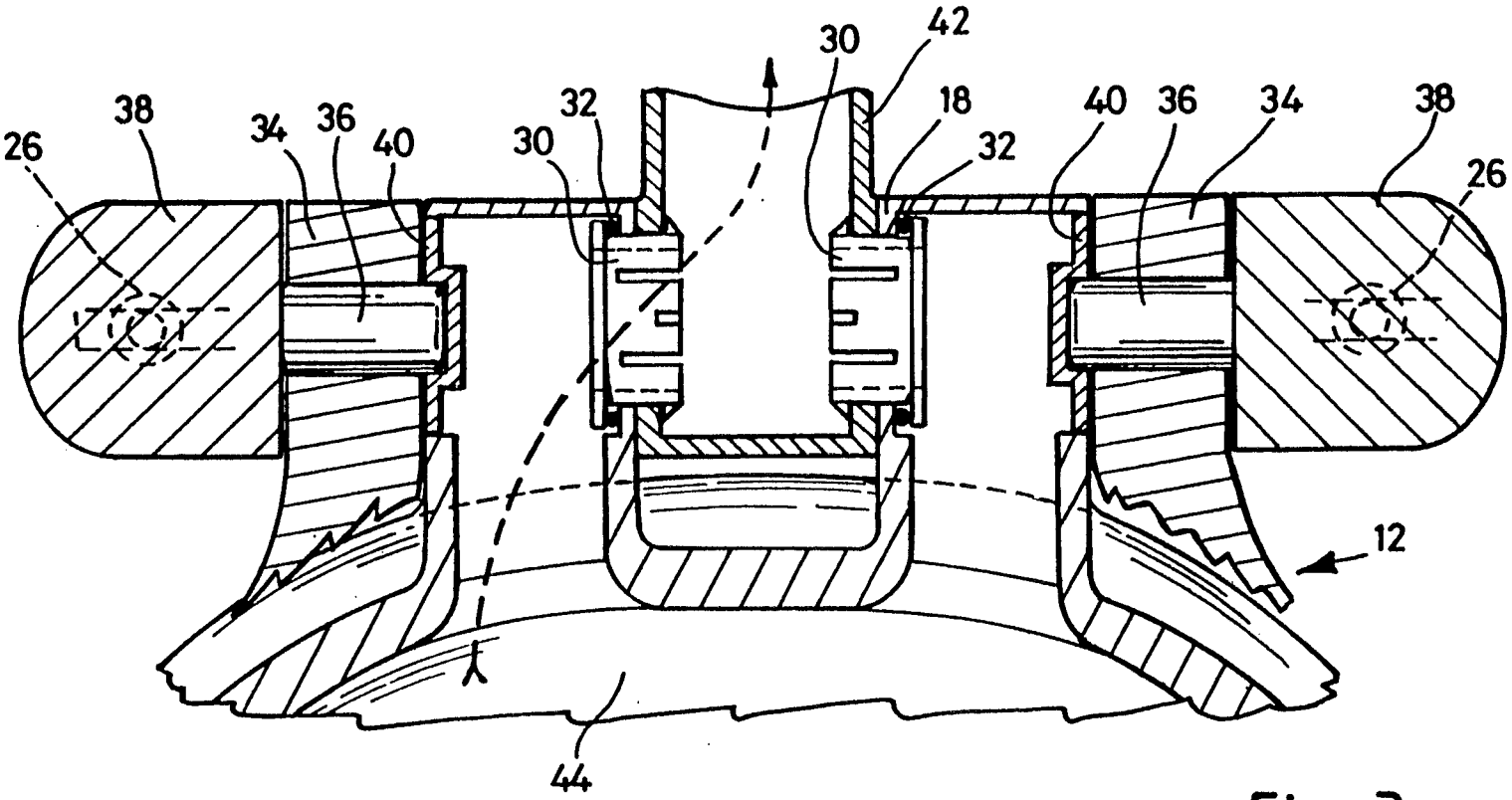
FIGS. 3 and 4 are cross-sectional views through the hinging means, in horizontal and vertical planes respectively.
Figure 4:
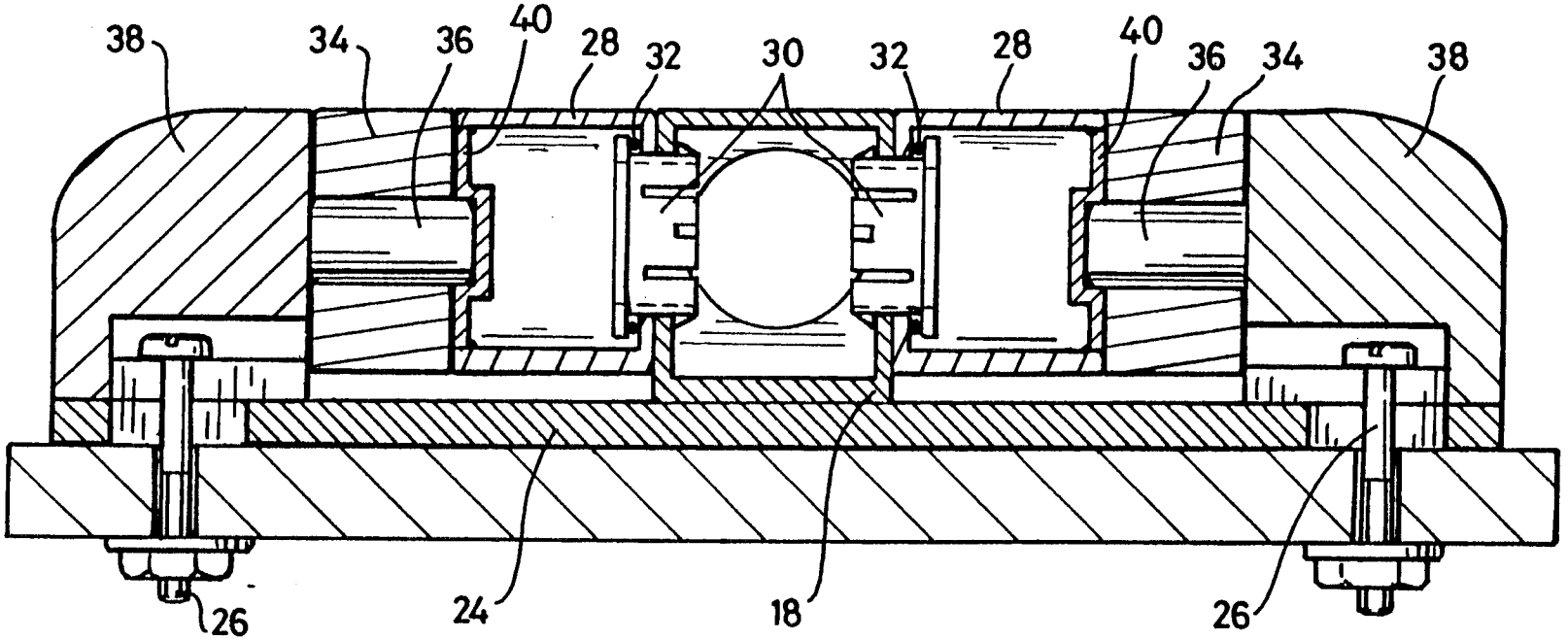

The construction of the hollow hinging means is shown in FIGS. 3 and 4. This includes a base plate 24 with which the centre piece 18 is integrally formed, the base plate fixing to the rear of the pan in a conventional manner by means of nuts and bolts 26. Two hollow cheeks 28 on the seat at the rear thereof, one on each side of the centre piece 18, are pivotally mounted to turn relatively to the centre piece in order to provide for hinging of the seat. Pivotal mounting is by means of hollow cylindrical inserts 30 pushed into apertures in the wall of the centre piece 18 on opposite sides thereof. O-ring seals 32 are located between the cheeks and the inserts. Outwardly of the cheeks 28 of the seat, the cover 12 is pivotally mounted by means of cover cheeks 34 and pivot pins 36, and the hinging means also includes end pieces 38 held in place in a conventional manner by the heads of the fixing bolts 26. Separately formed bearing elements 40 constitute part of the cheeks of the seat and are shaped to provide supplementary pivotal bearings, on the ends of the pivot pins 36, on the sides of the seat cheeks 28 adjacent the cover cheeks 34. The separate bearing elements 40 are necessary to enable insertion of the inserts 30 during assembly, first of the seat and then of the cover, to the pan during installation. The centre piece 18 includes a short outlet connection pipe 42 which connects to the air outlet pipe 20 shown in FIGS. 1 and 2.

In FIG. 3, the internal air channel in the seat is referenced 44. As indicated by the dashed line, air flow from this channel when the fan is operative is via the hollow cheeks of the seat and through the hollow inserts 30 into the outlet connection pipe 42 of the centre piece.

Referring to FIGS. 5 to 8, it can be seen that the pan seat comprises an upper part 46 and a lower part 48 assembled therewith in order to form the internal air channel 44 between them. Both parts have a shape generally conforming to the shape of the rim of a conventional lavatory pan, but the lower part has a perimeter incomplete at the front, and thus assumes a shape similar to that of a horseshoe (see FIG. 8 for example). The hollow cheeks 18 of the seat which form part of the hinging means are integral with the upper part 46. The interior of said hollow cheeks communicates with the internal air channel 44.

The lower part 48 is formed on its upperside (see FIG. 8) with an air flow groove 50 extending around the length of the part and terminating just before the two ends of the part. Formed through the wall of the part 48, at the inside periphery thereof, are the air inlet apertures 14, the entrances to which face both generally downwardly and inwardly. The apertures 14 open into the air flow groove 50.

Figure 9:
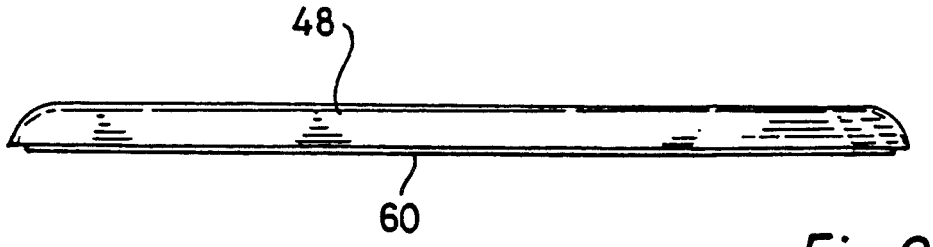
FIG. 9 shows the lower part of the seat in side elevation.

The lower part 48 is provided on its underside with a sealing strip groove extending around the length of the part whereby a sealing strip 60, visible only in FIG. 9, is fitted to the groove to cover the heads of screws 52 extending through screw holes provided to enable the lower and upper parts of the seat to be fixed together.

A hole is also provided at the underside of the part 48, right through to the groove 50, for accommodating a microswitch 54. The microswitch will be operated by pressure on and compression of the sealing strip at the point where the microswitch is located. A connecting lead 56 to the microswitch extends around the groove 50 to emerge through the air extraction passage through the hinging means.

Figure 5:
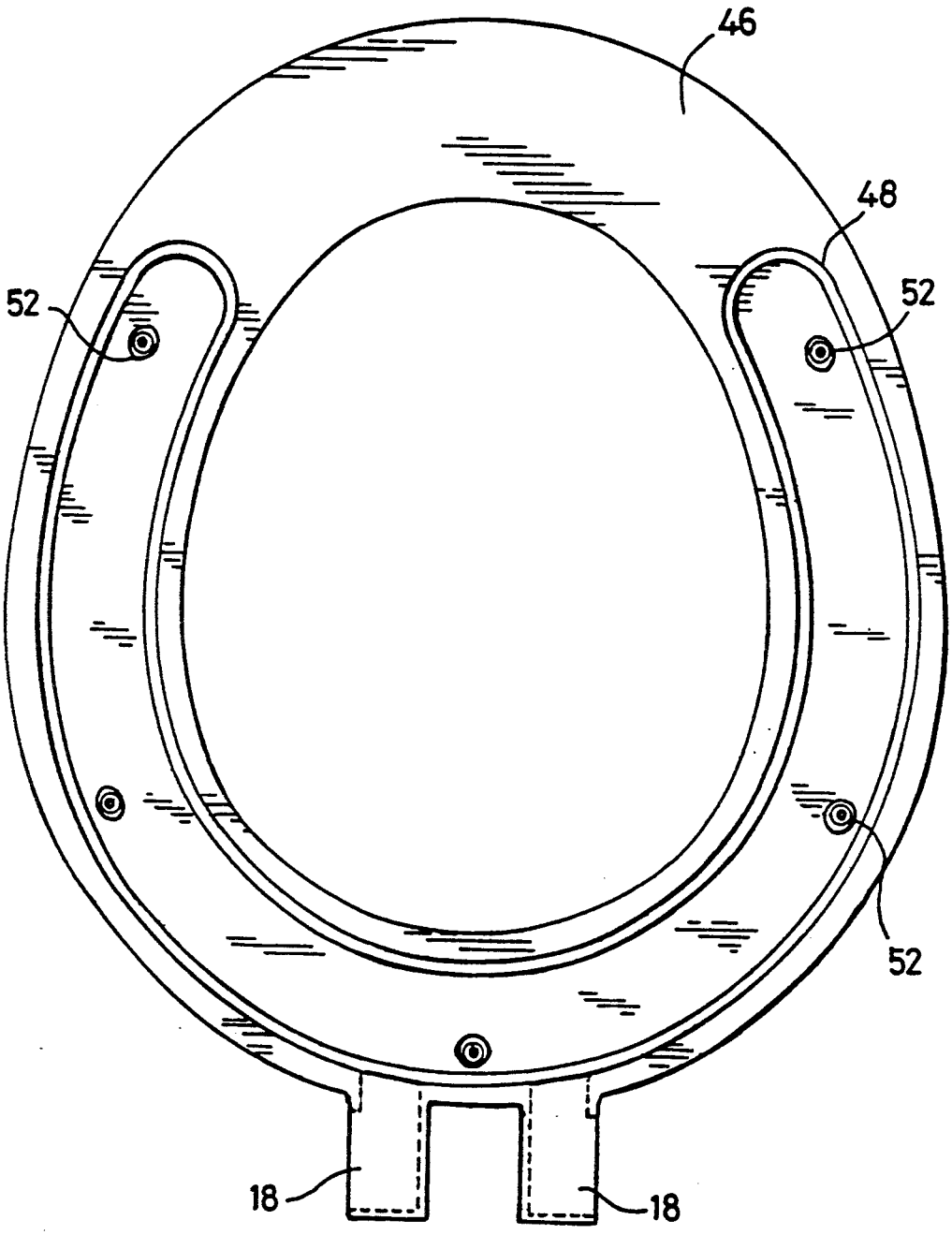
FIG. 5 shows the seat in underplan.
Figure 6:
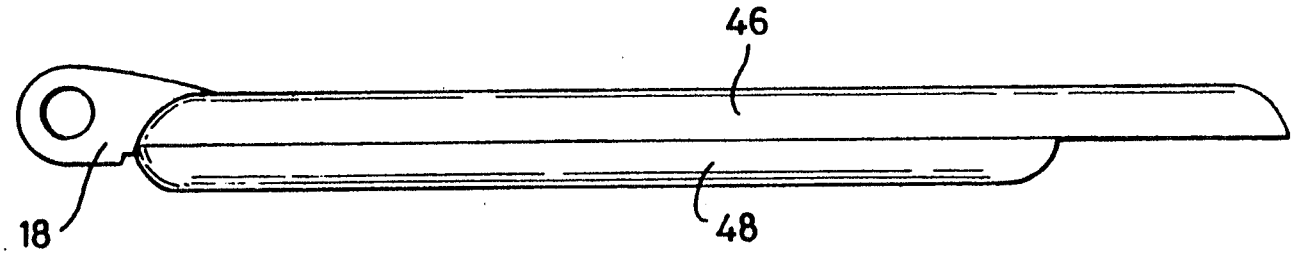
FIG. 6 shows the seat in side elevation.
Figure 7:
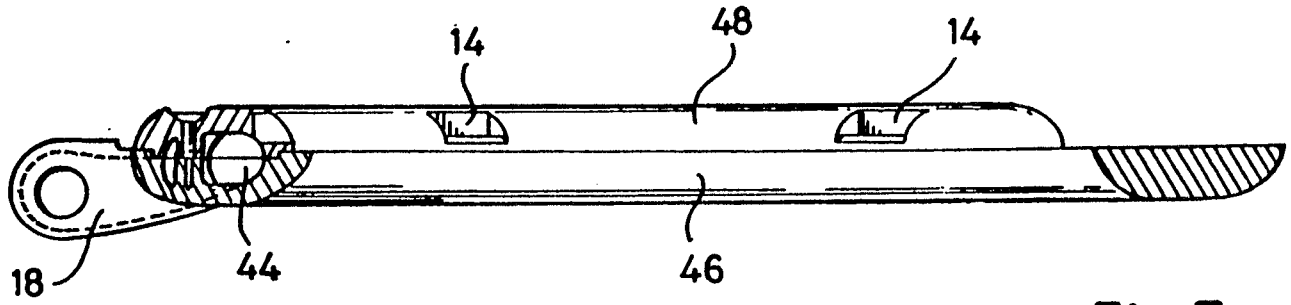
FIG. 7 is a vertical cross-section through the seat, when inverted, on the front to back centre line thereof.
Figure 8:
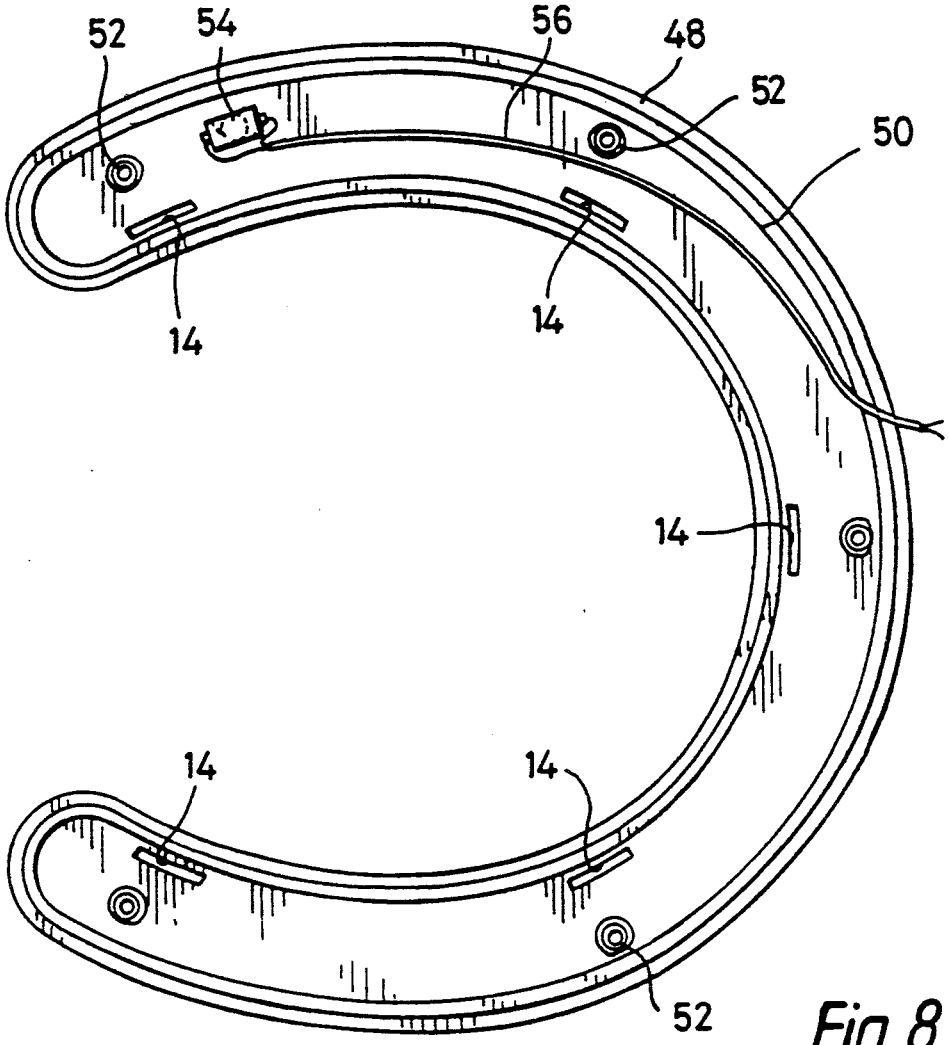
FIG. 8 is an underplan view of the lower part of the seat.

The upper part 46 of the seat, as shown in FIG. 5, has a complete perimeter, and is formed around the major part of its length, on its underside, with a groove matching the groove 50 in the lower part 48. As previously stated, the hollow cheeks 18 of the hinging means are also integral with this upper part 46, with the interior thereof communicating with the internal air channel defined by the matching grooves in the upper and lower parts.

When in use the lavatory is used by a person sitting on the seat, the microswitch will trigger a relay timer, setting the fan into operation for the duration of closure of the microswitch and a preselected period thereafter.

As the space within the pan is substantially closed, although able to draw air in through the gap created by the incomplete front of the lower part of the seat, any odours produced in the space will be directly extracted.

The above-described seat may be machined from wood, or may be injection moulded of suitable plastics material such as UPVC. However, many modifications of the above-described arrangement are possible within the scope of the invention. For example, it may be practicable to form the plastics seat in one part, instead of upper and lower parts, by rotation moulding. When the seat is made of wood, the hinging means may be of metal, such as aluminium, and may incorporate nylon bearings.

The extraction fan is preferably operated from the mains electricity supply, but could be powered from batteries, preferably rechargeable batteries. Moreover this fan, instead of extracting air to the exterior, may act to recirculate air through a suitable filter, such as a charcoal filter.

Again, in practice, the strip for sealing the seat against the rim of the pan is not essential and, when it is provided, it may not cover the screws fixing the upper and lower parts of the seat together. Rather, said securing screws may be formed to be readily releasable, for example being replaced by quick-release bayonet-type fasteners, so that the lower part of the seat can be removed (when the seat is raised) to enable the interior air flow channel to be cleaned. It is also possible, in this connection, to locate the fan-controlling switch elsewhere, preferably towards the back of the seat, so that wiring through the interior air flow channel is minimised or avoided. An arrangement in which the switch is located in the hinging means is described later.

Moreover, while a series of air inlet apertures around the inside periphery of the seat are preferred, it may sometimes be sufficient, for example if a stronger extractor fan is employed, to provide a single, larger air inlet aperture at the back of the seat, communicating directly with the air extraction passage through the hinging means. In this case the air flow channel inside the seat is not required, and the main portion of the seat can be of a solid construction, thus facilitating its production in one piece. The hinging means may also be arranged in a variety of ways, and one alternative arrangement will now be described by way of example with reference to FIGS. 10 to 15.

In this construction, a base plate 61 fixing by screws to the lavatory pan in a conventional manner carries a hollow centre piece 62 which at the back has an aperture in which is received an adaptor plate 64 formed with a stub pipe 66 to which attaches the hose leading to the extractor fan. The provision of such an adaptor plate 64 enables the use of different sizes and shapes of tubing or piping leading to the fan.

Figure 13:
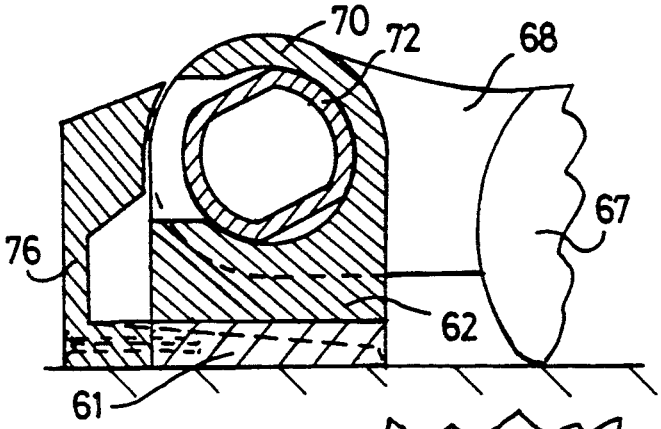
FIG. 13 is a vertical cross-section on the line Y—Y of FIG. 10.
Figure 14:
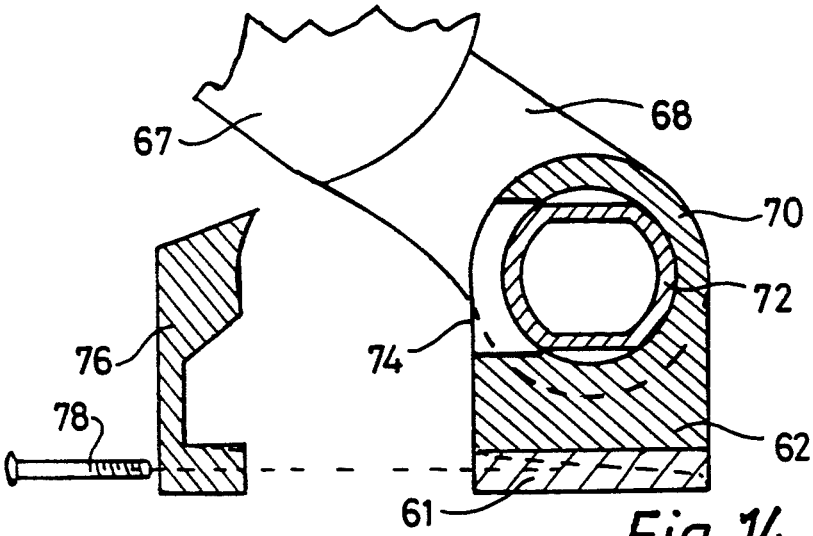
FIG. 14 is a cross-section corresponding to that of FIG. 13, but showing the manner of assembly of the seat and hinging means.
Figure 15:
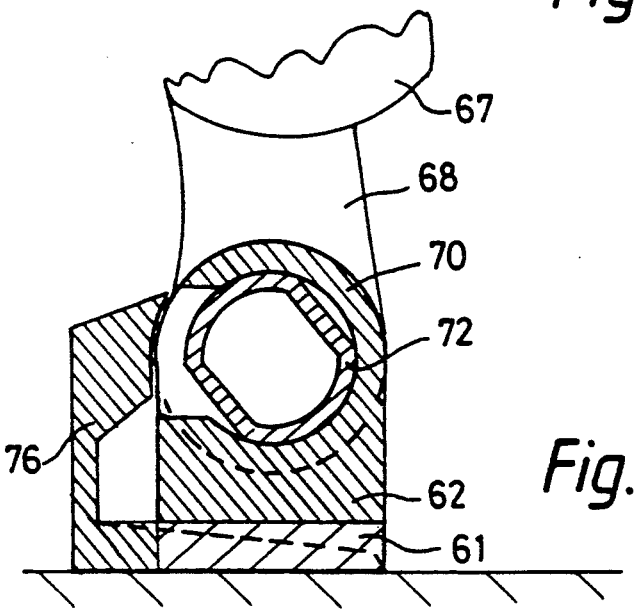
FIG. 15 is a cross-section corresponding to that of FIG. 13, but with the seat raised.

The seat 67 is again formed at the back with two hollow cheeks 68 for securing in hinging relationship to the centre piece 62. For this purpose, as shown in FIGS. 13, 14 and 15, the side faces of the centre piece 62 and the inner side faces of the cheeks 68 are formed with shaped cross sections 70 and 72, respectively, which enable the seat to be assembled into the centre piece from the back, as shown in FIG. 14, the cross section of the centre piece being open at the back for this purpose, as indicated at 74. This assembly takes place at the manufacturing stage, as space is not available to assemble the seat into the centre piece in this way once the centre piece is fixed to the pan. Thus, although as shown in FIGS. 13 and 15 the seat is able freely to turn between lowered and raised positions, the bearings formed by the cooperating cross sections 70 and 72 eliminate any looseness in the seat mounting.

Moreover, after assembling the seat to the centre piece in the above-described manner, closure members 76 are fixed into position behind the rear ends of the cheeks 68 of the seat by securing screws 78. The purpose of these closure members 76 is shown in FIGS. 11 and 12.

First, the hollow cheeks 68 of the seat are each formed with a passage 80 communicating with the interior of said cheeks, and thus with the air flow channel within the body of the seat 67. Additionally, the wall of the cheek 68 defining one side of this passage 80 is formed as a projecting lip 82.

Second, each closure member 76 is shaped with an abutment 84, faced with a sealing strip 86, against which the lip 82 abuts when the seat is in its lowered position (FIG. 11), thus closing the end of the passage 80, which otherwise would enable escape of air when the fan is operative. However, when the seat is raised, as shown in FIG. 12, the passage 80 is open into a channel 88 formed in the base plate 61 of the hinging means, which channel leads back towards the interior of the pan. Thus, when the seat is raised, any liquid present in the air flow channel within the body of the seat 67 is able to drain through the interiors of the cheeks 68 back into the pan.

Figure 11:
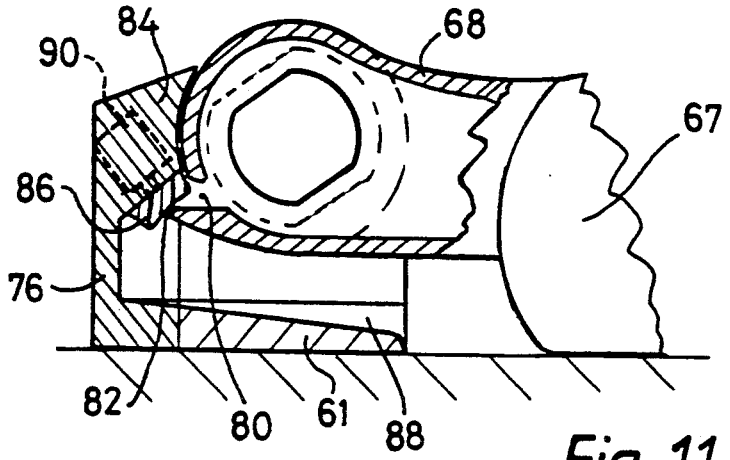
FIG. 11 is a vertical cross-section on the line X—X of FIG. 10.
Figure 12:
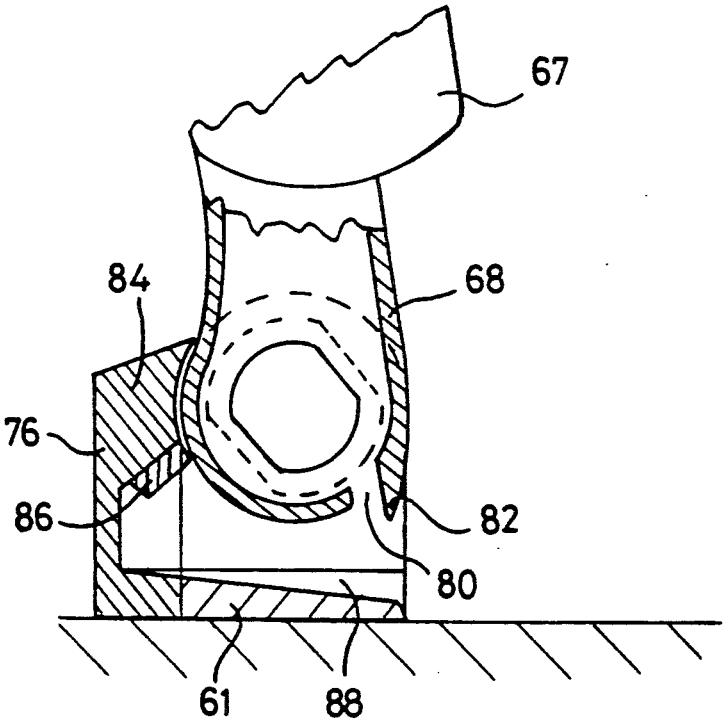
FIG. 12 is a cross-section corresponding to that of FIG. 11, but with the seat raised.

Moreover, as shown in FIG. 11, the abutments 84 of one of the closure members 76 may incorporate a pressure switch 90 for operating the extractor fan, this switch being operated when the seat 67 is lowered and pressure is applied thereto to compress the sealing strip 86.

Figure 10:
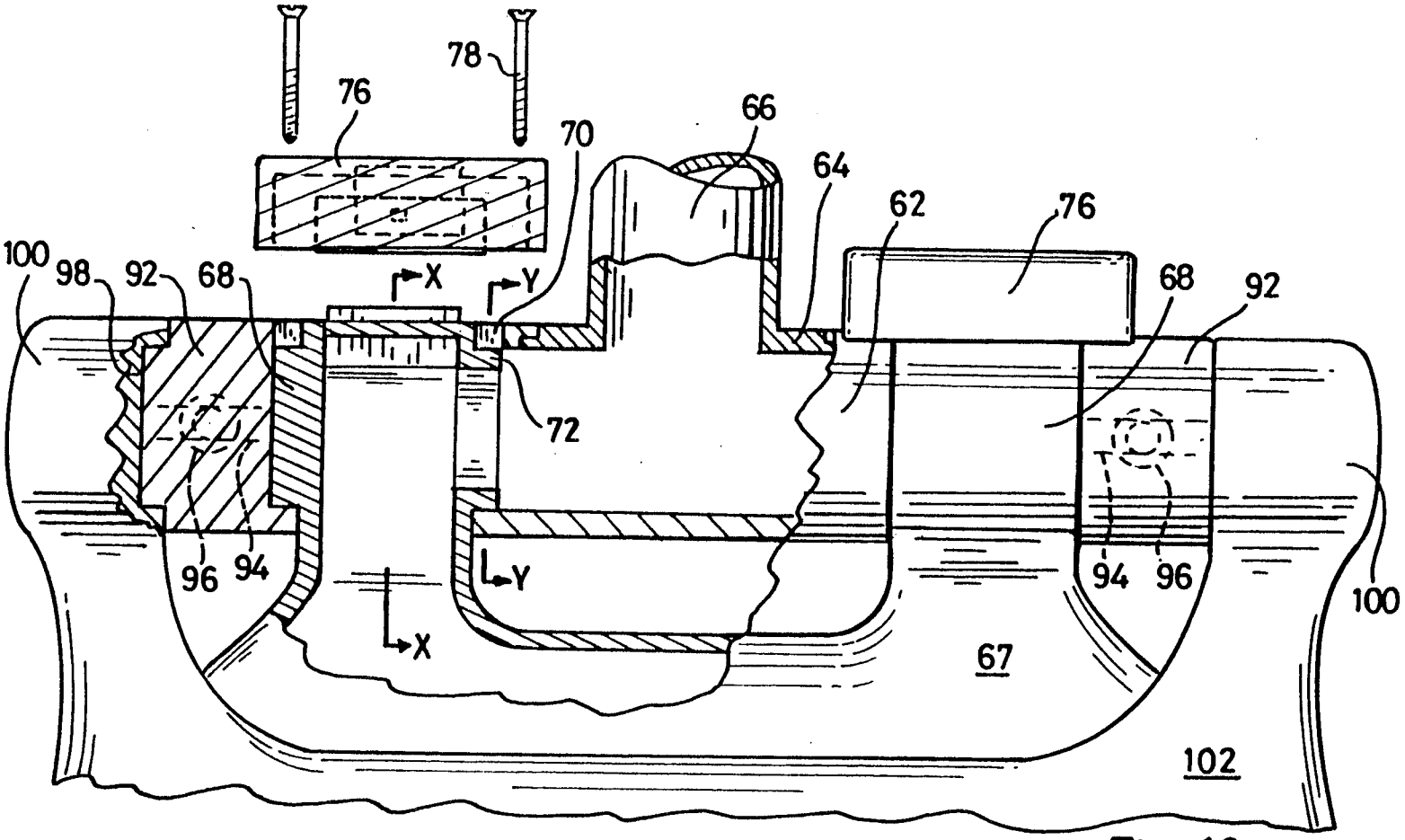
FIG. 10 shows a modified seat hinging arrangement, partly in plan and partly in horizontal cross-section.

Reverting to FIG. 10, outside the cheeks 68 on the seat 67, the base plate 61 of the hinging means also carries upstands 92 (conveniently used to receive in adjustment channels 94 the heads of the screws 96 which fix the entire assembly to the pan) which incorporate on their outer side faces pivots 98 on which are mounted to turn two spaced lugs 100 projecting from the back of a lid or cover 102 for the lavatory pan.

FIGS. 10 to 15 have been used to describe a variety of features any one or more of which may or may not be incorporated in a particular design of seat. Thus, while the manner of assembly of the seat and the hinging means in FIGS. 1 to 7 differs from that of FIGS. 10 to 15, it is readily possible to modify the first described hinging means to incorporate either or both of the liquid escape passage and the pressure switch for operating the fan, if desired.

What is claimed is:

1. A lavatory pan seat, comprising:

a seat member having a shape which substantially conforms to a shape of a rim of a lavatory pan, said seat member including:

two spaced hollow cheeks at a back end, said hollow cheeks having opposing inner side walls each including an opening therethrough, at least one of said hollow cheeks further having a liquid escape passage formed therein, a plurality of air inlet apertures in a wall adjacent an inside periphery, and, air flow channels within the interior of said seat member extending around said seat member to communicate said air inlet apertures with said interiors of said hollow cheeks;

a hollow center piece adapted and capable of being fixed to the lavatory pan at a back side of the rim, said center piece having, at its back, an air extraction opening communicating with the interior of said hollow center piece, and having opposing outer walls each including an opening therethrough;

means for securing said hollow cheeks of said seat member in communication with said hollow center piece respectively on opposite sides of said hollow center piece; and, bearing means located at the outer side walls of said hollow center piece and inner side walls of said hollow cheeks for forming hinging means for enabling said seat member to hinge relative to said hollow center piece, said bearing means being formed for enabling air undergoing extraction to pass from said inlet apertures into said air flow channels and then into said hollow cheeks and from the interiors of said hollow cheeks through said bearing means into said hollow center and, thereafter, to the air extraction opening, said at least one cheek cooperating with said center piece such that said liquid escape passage is in communication with said air flow channel when the seat is raised and closed to said air flow channel when the seat is lowered, said liquid escape passage being directed downwardly when the seat is in the raised position.

2. A pan seat according to claim 1, formed in generally similarly shaped upper and lower parts which define the air flow channel between them, the hollow cheeks being integrally formed with the upper part with their interiors communicating with said air flow channel.

3. A pan seat according to claim 2, wherein the upper and lower parts are releasably secured together.

4. A pan seat according to claim 1, in combination with an extractor fan communicating by means of a hose with the air extraction passage.

5. A pan seat according to claim 4, wherein the center piece incorporates a switching device for switching on the fan when the seat is lowered and pressure applied thereto.

6. A pan seat according to claim 1, in combination with a pan cover having two spaced lugs by means of which the cover is pivotally mounted to the pan coaxially with the seat hinging means and with said hinging means disposed between said lugs.

* * * * *